United States Patent [19]

Sexton

[11] 4,442,907

[45] Apr. 17, 1984

[54] APPARATUS FOR STRINGING WELL PIPE OR CASING

[76] Inventor: John L. Sexton, R.D. 2, New Concord, Ohio 43762

[21] Appl. No.: 408,113

[22] Filed: Aug. 16, 1982

[51] Int. Cl.[3] ..... E21B 19/16

[52] U.S. Cl. ..... 173/164; 173/73; 166/85

[58] Field of Search ..... 173/90, 91, 164, 73, 173/165, 166, DIG. 3, 149, 167; 285/39, 404; 403/16, 362, 366; 279/85, 110, 9 R, 16, 17, 18; 166/85, 78

[56] References Cited

U.S. PATENT DOCUMENTS

| | | | |
|---|---|---|---|
| 1,264,155 | 4/1918 | Chapman | 173/164 |
| 2,054,223 | 9/1936 | Le Bus | 173/164 |
| 2,240,738 | 5/1941 | Dunn | 173/167 |
| 3,685,844 | 8/1972 | Sykes | 279/110 |
| 3,768,579 | 10/1973 | Klein | 173/164 |
| 3,915,243 | 10/1975 | Hisey et al. | 173/164 |
| 4,361,353 | 11/1982 | Vinson | 285/404 |

*Primary Examiner*—E. R. Kazenske
*Assistant Examiner*—Hien H. Phan
*Attorney, Agent, or Firm*—Francis T. Kremblas, Jr.

[57] ABSTRACT

An apparatus for use in running a string of threaded well pipe or casing in a vertical configuration in a deep well bore which is adapted to convert a top head drive drilling rig for use in running each length of pipe into the well bore. A drive spindle adaptor is provided which may be securely attached in a removably mounted manner to the rotary drive spindle or sub of a top head drive drilling rig. The drive spindle includes a pair of opposing, outwardly extending lugs disposed at a right angle to the axial direction of the spindle and a true centering guide means. A collar is included which is provided with frictional gripping members for removably securing the collar to one end of a length of conventional pipe and a pair of axially extending, spaced ears which cooperate upon engagement with said lugs on said spindle adaptor to transfer rotary motion of said spindle to said length of pipe.

3 Claims, 6 Drawing Figures

APPARATUS FOR STRINGING WELL PIPE OR CASING

BACKGROUND OF THE INVENTION

Oil and gas drilling operations have increased dramatically over the last decade. Each new producing well requires the installation of the casing or pipe comprising many lengths of individual pipes which are threaded to one another as it is added to those in the well bore. As each new length is added and lowered into the hole, another length of pipe must be positioned and threaded to the uppermost pipe in the string.

This operation is a relatively time consuming and expensive process. Prior methods and means have consisted of using a very expensive piece of equipment, referred to as power tongs, or a rather cumbersome technique that utilizes the rotary head of a top head drive drilling rig adapted with a special spindle and a threaded plug.

The power tongs are a special piece of equipment used solely to grip the pipe tube and torque a length of pipe to threadably connect it to the upper most length of pipe in the string already in the hole. The other method using the rotary head of the drilling rig to rotate pipe for makeup or break out requires threading an adapter plug into the pipe coupling member prior to rotating the pipe itself. Then the adapter must be torqued in the opposite direction to release it from the pipe coupling. One of the drawbacks of using such an apparatus is that this technique sometimes causes an inadvertent unthreading in the pipe string which is obviously undesirable.

While it is desirable to be able to employ the existing rotary drive head of the drilling rig rather than require an additional piece of equipment such as power tongs costing approximately twenty to twenty-five thousand dollars, the cumbersome and time consuming process used the the unreliability encountered has forced many users to use the power tongs in spite of the expensive investment.

However, a very serious problem using the expensive power tong device can also be encountered when a pipe coupling has not been threaded fully onto the pipe prior to connecting this pipe into the string. Since the power tong only torques the pipe or tube itself, a loose or hand tight coupling may be unnoticed and may result in the entire string being dropped into the hole. Such occurrences are not rare and represent a very costly accident. Another disadvantage to the use of tongs is that at least two additional workers must be involved. This adds additional expense in the operation and makes a more crowded work place, which is a less safe work condition. Further, since the tong device actually grips the pipe or tube itself, damage to the casing may result.

While many, many years have passed, these problems encountered in running well pipe and casing have not been satisfactorily solved prior to the present invention.

SUMMARY OF INVENTION

The present invention relates generally to apparatus for use in running pipe or casing into a well and particularly to an improved and simplified apparatus which makes possible the use of the top head drive drilling rig to handle the manipulation and torquing of the pipe to thread one to another. In accordance with the present invention, a drive spindle adaptor is provided which is adapted to be removably mounted on the rotary drive head of the top head drive drilling rig and includes a pair of opposed lugs extending outwardly from the body of the spindle and a lower end provided with a true centering or alignment guide means. In cooperation with this drive spindle, a collar portion is provided which is adapted to be removably mounted over the coupling member carried on the pipe to be attached in the string. This collar includes adjustable friction gripping members which frictionally engage the coupling on the pipe and a pair of vertically disposed ear-like members. The ear-like members cooperate with the drive lugs on the spindle portion when the spindle is positioned properly to provide rotational engagement between the spindle and collar which is transmitted to the pipe.

Therefore, in conjunction with a conventional elevator apparatus used on a conventional drilling rig, along with a spider and slips device for releasably supporting the pipe string, as is common in a pipe running process, the present invention provides an improved, inexpensive, reliable and efficient apparatus to insert and connect or disconnect pipe in a well bore.

OBJECTS

It is a primary object of the present invention to provide an improved, yet inexpensive apparatus adapted to be used with a top head drive drilling rig for running pipe or casing into a water well or an oil or gas well bore.

It is another object of the present invention to provide apparatus of the type described which eliminates the need for any expensive additional equipment for providing rotary power to torque a length of pipe to thread it into the string being inserted into the well.

It is another object of the present invention to provide apparatus of the type described which is significantly more efficient and time-saving in handling and connecting threaded pipe in the well bore as compared to prior methods and means.

It is a further object of the present invention to provide apparatus of the type described which is of very simple and inexpensive construction and easy to attach or remove from both the rotary head of the drilling rig and to the particular pipe which is being placed into the pipe string.

It is still another object of the present invention to provide an apparatus of the type described which requires less labor during the operation and improves safety conditions as compared to prior art methods and means.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
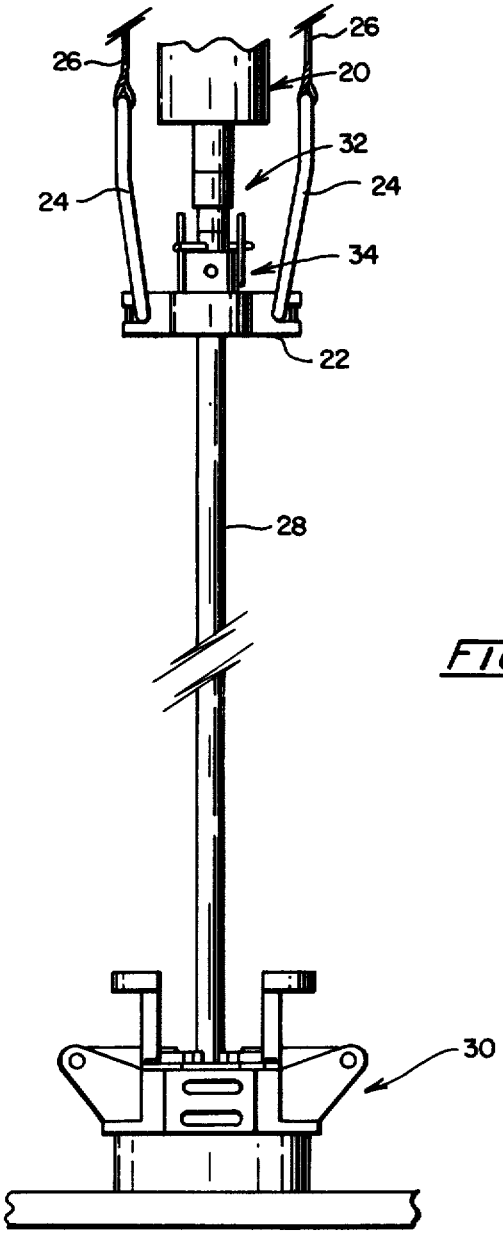
FIG. 1 is a front plan view of an apparatus constructed in accordance with the present invention shown in conjunction with a conventional spider and slip device and with a length of pipe positioned to be connected to the pipe string already within the well bore.
Figure 2:
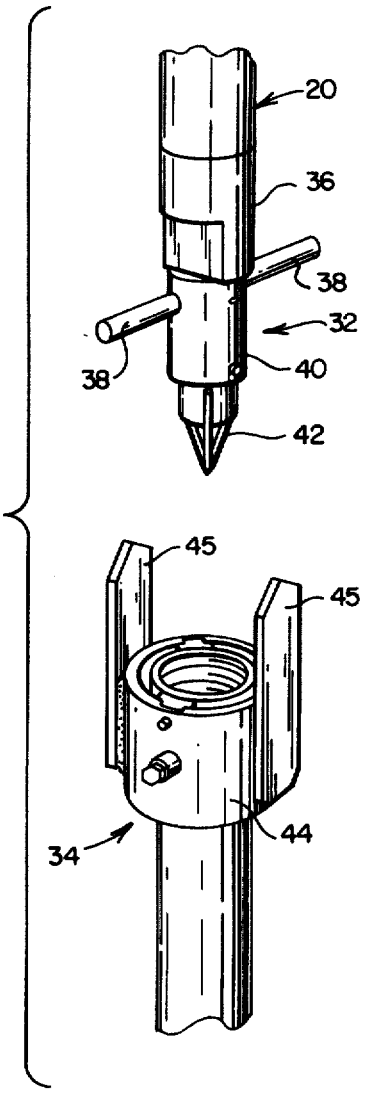
FIG. 2 is a partial perspective view of a portion of the apparatus shown in FIG. 1 illustrating the spindle adapter portion and the collar portion attached to a length of pipe.

An apparatus for use in running pipe or casing into a well bore constructed in accordance with the present invention is shown in FIG. 1. The apparatus is adapted to be used in conjunction with a top head drive drilling rig, not shown, which includes a rotary drive head, indicated generally at 20, which may be moved vertically in a controlled fashion. The foot-pounds of torque applied by drive head 20 is hydraulically controlled by the operator of such rigs in a conventional manner.

Also included on such rigs is a device referred to as an elevator which comprises a lifting head 22 carried by a pair of arms 24 which are mounted to the same hoisting mechanism which raises and lowers rotary drive head 20.

The arms 24 of the elevator device typically are mounted via pivots or flexible cables, such as 26, to permit it to be manipulated to swing outwardly from the rig in order to be connected to the next length of pipe being placed into string.

In a typical operation, several lengths of pipe or casing are disposed on the ground near the well bore and each include a coupling member attached to one end. When a new length is to be added to the string, the elevator is lowered to a position near ground level and then the lifting head 22 is swung outwardly. The conventional elevator head 22 comprises a releasable door means which permits the coupling end of the casing to be manually inserted inside the releasable door means of the elevator head 22. The door means is then closed in surrounding relationship to the pipe or casing. The elevator is then raised via the hoisting mechanism of the drilling rig which also lifts rotary drive head 20 to draw the casing upwardly until it reaches a vertical position overhanging the well bore such as pipe or casing 28.

The inside diameter of the typical elevator lifting head 22 is of a dimension which loosely surrounds the casing itself, but engages the shoulder of the coupling member attached to the upper end of the casing. Therefore the weight of the casing and, at a later stage of the operation, the weight of the entire casing string in the hole is supported by the threaded engagement of coupling member.

Another common device used in all pipe running operations is a conventional holding or support member referred to in the industry as a spider and slips indicated generally at 30. The spider and slips are a releasable gripping device which is mounted over the well bore and includes a set of releasably slips or jaws to grip the uppermost length of pipe or casing in the pipe string and support it during portions of the procedure. When the slips are engaged, it always supports the entire weight of the pipe string disposed in the hole.

Generally common procedure for running pipe casing into a well bore will now be described to more clearly point out the advantages of the present invention.

As mentioned above, the elevator device and spider and slips are conventional and necessary apparatus if a power tong device is used. The power tong is a separate apparatus which must be disposed over the well bore and above the spider and slips and in alignment with the vertical axis of a pipe casing lifted by the elevator device. The rotary head 20 of the drilling rig is not used since the tong device includes a releasable set of jaws and an outside power source to cause rotation of the jaws which are adapted to grip the pipe or casing itself. The tong device does not grip or engage the coupling member on the pipe or casing.

Prior to the present invention, if the rotary head of the drilling rig was utilized to apply torque to thread each new length of pipe or casing, a spindle adaptor was connected to the rotary head 20 which included a narrow neck portion provided with a hole. Also used was a threaded plug including a clevis arrangement which was removably connected to the neck portion of the spindle adaptor by means of a removable pin frictionally mounted through the clevis and the hole in the neck portion of the spindle. The connection to a new length of pipe was made by threading the plug directed into the coupling member on the pipe or casing. Only after the plug member was fully threaded, was torque applied to the pipe or casing itself to assure that the lower end of the casing was threaded into the uppermost coupling member on the top of the pipe string already disposed in the well bore.

Then the torque from the rotary drive head must be reversed to remove the threaded plug from the coupling so that the entire process could be repeated. This process also required a worker positioned on the rig floor level to manually assure alignment and proper engagement of the threaded plug and the coupling or to remove and replace the pin connecting the plug and spindle portion if two plug portions are used with the extra one being hand positioned on the next pipe or casing prior to being lifted into position by the threaded plug device.

In either of these methods, once the newly added pipe or casing has been threaded into the pipe string, the spider is released so that the whole string can be lowered to make room for the next length of casing to be added. During this step, the entire weight of the string is supported by the engagement of the threaded plug into the coupling member of the newly added length of pipe or casing. If the male threads of the plug are not carefully checked for wear, thread failure caused by the weight of the entire string results in dropping the entire string into the well bore.

In a situation where the tong is used which directly grips the pipe or casing tube rather than the coupling attached thereto, a loose coupling member would not be effected by the torque applied to the casing. Such a loose coupling could fail when the string is being lowered using the elevator device and result in dropping the entire portion of the string which has been already made up and lowered into the well bore.

The cost and time lost in such cases wherein the string is dropped represents a very undesirable and unexceptable major expense in such operations. Recovery of the string can be so prohibitively expensive in some cases that the only recourse is to abandon the well bore.

Now, referring specifically to the improved apparatus constructed in accordance with the present invention, an improved spindle adaptor portion indicated generally at 32 cooperates with an improved casing collar portion indicated generally at 34 to provide a relatively simple much more reliable and efficient apparatus.

The spindle adaptor portion includes a main body portion 36 which is provided with a conventional male threaded portion, not shown, adapted for threadable engagement with the rotary drive head 20 provided on top head drive drilling rigs. Body portion 36 is also provided with a pair of outwardly extending lugs 38 which may be either permanently connected to body 36 or alternatively may be formed by a single pin removably fixed in any conventional manner.

Preferably, the lower end of body 36 is provided with a reduced diameter section 40 and a cone shaped or tapered guide means 42 to facilitate the proper alignment with the coupling member on a conventional pipe or casing.

Collar portion 34 includes a generally cylindrical body 44 and a pair of upstanding ear-like members 45 permanently attached to body 44.

Figure 3:
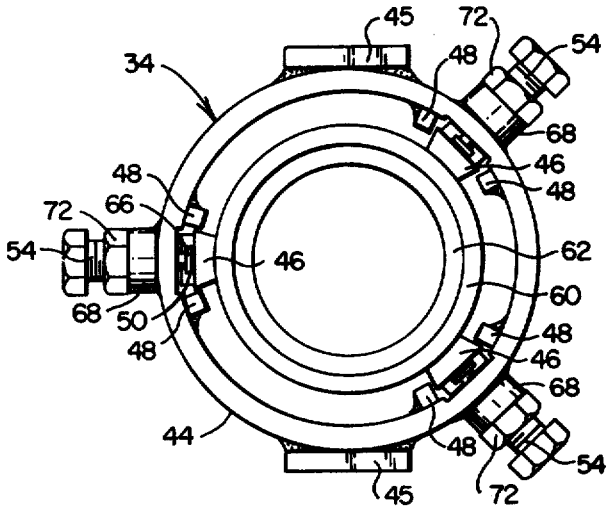
FIG. 3 is a top plan view of the collar portion shown in the preceding Figures illustrating the frictional gripping members in engagement with the conventional coupling member attached to a conventional length of well casing.
Figure 4:
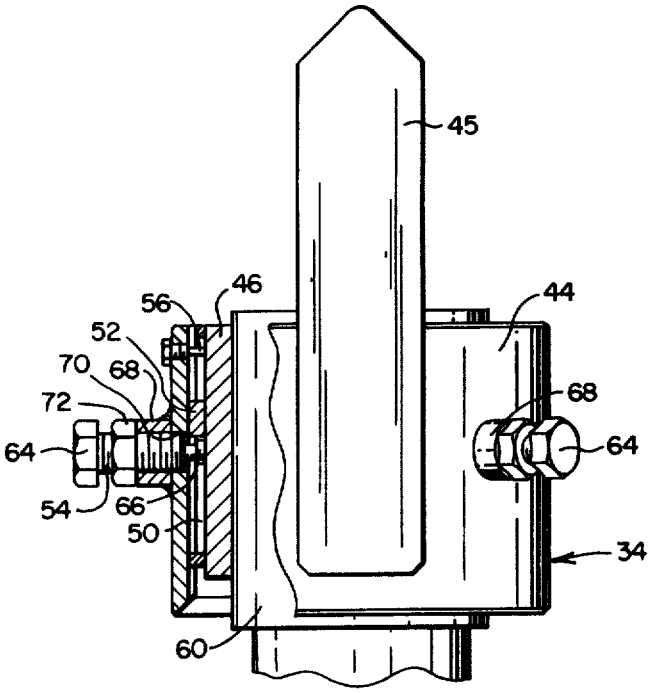
FIG. 4 is a side plan view of the collar position shown in FIG. 3 with a portion in section illustrating the clamping or frictional gripping member.

As best seen in FIGS. 3 and 4, collar portion 34 includes a plurality of gripping members 46 disposed radially about the inner surface of body 44. Each gripping member 46 is mounted within a pair of guide members 48 provided on the inner surface of body 44 forming a slot like vertical opening. Members 48 act as a stop limiting circumferential movement of each gripping member.

Each gripping member includes an inner face preferably notched or roughened in a suitable manner to increase the frictional engagement with the outer surface of a pipe coupling member. The outer face of each gripping member 46 is provided with a vertical recess 50. A protrusion 52 is provided at a predetermined vertical position interrupting slot 50 and functions as a stop means limiting vertical travel of the members 46 upon engagement with either the end of the adjustable threaded member 54 or upper stop bolt 56.

As seen in FIG. 3, with collar 34 disposed over the coupling member 60 of a length of pipe, the gripping members 46 may be moved into or out of engagement with the coupling member 60 by manipulation of threaded member 54.

Threaded member 54 includes an outer head portion 64 and an inner foot portion of reduced diameter 66 which is disposed within slot 50 provided on the outer surface of gripping member 46. A threaded nut-like member 68 is fixed by welding or the like to the outer wall of body portion 44 and is aligned with an appropriate opening or hole 70 provided in body 44.

A locking nut 72 is disposed on the threaded portion of member 54 adjacent to threaded member 68.

To use the apparatus of the present invention, one first attaches the spindle adaptor portion 35 to rotary head 20 of the drilling rig by means of a conventional threaded connection which is generally standard for attachement of various drilling equipment to such rotary drive heads.

Next a collar portion is placed in position over the coupling member 60 of a length of pipe casing 62 as it is disposed next to the well site. The collar is firmly affixed to the coupling member by tightening threaded members 54 to cause engagement of gripping members 46 with the outer wall of the coupling member.

The elevator device is now lowered and manipulated to a position which allows a worker to position the open door of the elevator head 22 around the pipe casing just below the coupling member and the door is closed. Now the elevator is actuated by the operator to raise the elevator head 22 and the pipe to a vertical position overhanging the well bore.

The distance between the spindle adaptor 32 and the elevator head 22 of the elevator is such that in the fully raised position, wherein the pipe or casing is vertical and generally contacting the coupling member of the last length of pipe held above the well bore by spider and slips 30, the spindle is approximately 1 or 2 feet above the coupling and attached collar 34.

At ground level, the lower end of the pipe held by the elevator lifting head 22 is manually guided into alignment with the coupling member of the last pipe casing in the string. Then the operator lowers the elevator which allows the elevator head 22 to slide downwardly along the pipe or casing until the guide means 42 enters the coupling member with the lugs 38 disposed between ear-like members 45 on collar 34.

When this alignment is achieved, the operator actuates the appropriate controls on the rig to cause rotation of rotary head 20 and spindle 32. The engagement between lugs 38 and members 45 transfers this rotation to collar 34 attached to coupling member 60 and pipe casing 62.

It should be pointed out that the coupling member is normally attached to the casing at a factory site and machine tightened. However, if human error in factory inspection occurs, and the coupling is loose, only hand tight, the action described above assures that the coupling member will be torqued properly, prior to, or essentially simultaneously when torque is being applied to the casing itself. Further, since the collar is released by merely loosening the frictional engagement of gripping members 46, no reverse torque need be applied to remove the collar 34 and therefore, there is no chance that an inadvertent loosening of the coupling will occur such as may happen using the prior threaded plug and clevis apparatus.

Also, it is important to note that the collar portion 34 must only accomodate the torque applied to the coupling and the vertical weight or force of the string of pipe or casing is always supported by either the coupling and elevator or the spider and slips engaging the casing itself.

If any slippage of collar 34 occurs during the torquing operation, it can be very readily observed by the ground operator as the casing will not be turned into the lower coupling member.

After torquing is completed, collar 34 may be removed and the elevator head 22 is lifted to engage the lip of the coupling member. Then the spider and slips may be released to permit the newly added length of casing and the whole string to be lowered into the bore hole. At the appropriate distance, the elevator is stopped with the coupling on the top end at the appropriate level for the next casing length to be added. The spider and slips are then re-engaged to support the whole string and the elevator door is released so a new length may be attached in the same manner as previously described.

Utilizing a three man crew and a second collar portion 34, a significant time saving can be achieved as the second collar 34 may be attached to a new length of casing during the operation described above. Then upon removal of the collar 34 from the newly added length of casing, the whole procedure may be immediately repeated.

Other advantages of using the apparatus of the present invention as compared to prior methods involves the more efficient use of labor. While a two man crew could very adequately install the pipe or casing, a three man crew would be most efficient, particularly since there is some relatively heavy manual effort required in positioning the next length of casing within the door of the elevator lifting head 22.

However, prior methods and means require additional personnel. For example, the power tong device generally requires at least one and sometimes two additional men just to operate the tong. The prior threaded plug procedure required an additional man at the rig floor level to guide or handle the engagement between the rotary spindle portion and the plug.

Further, the present invention substantially lessens, if not eliminates, the chance of dropping the entire string into the hole because of a failure due to a loose coupling or worn threads such as encountered using the prior plug and clevis device.

Generally, safety is improved considerably, using the apparatus of the present invention, since it is simple and it does not require crowded labor conditions at the well bore, such as when the tongs are used. Further, upon inadvertent operator error, such as actuating the torque control instead of the vertical lifting control, it cannot cause whip lash movement or side thrust of a casing during the lifting operation, such as might occur using the threaded plug and clevis procedure.

Figure 5:
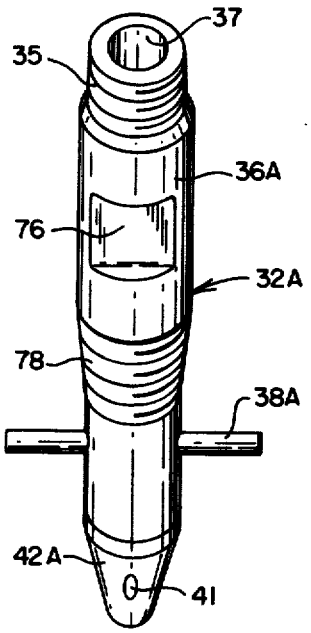
FIGS. 5 and 6 are other embodiments of the invention.
Figure 6:
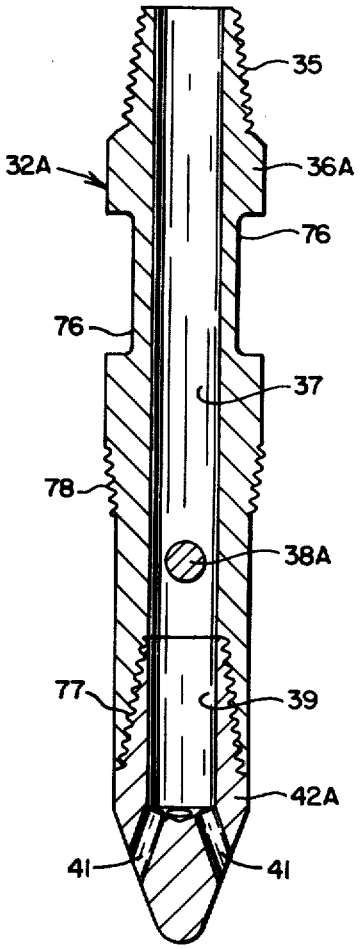

Now referring specifically to FIGS. 5 and 6, another embodiment of the present invention is shown which relates to a modified spindle portion indicated generally at 32-A.

Spindle portion 32-A is basically used in the same manner as previously described relating to cooperating with collar portion 34. The modification relates to providing means to use the conventional equipment typically provided on a drilling rig to inject air or fluid through the rotary drive head 20 and into the casing, when circulation of fluid into the well bore is necessary.

Spindle adapter portion 32-A includes a main body portion 36-A and a lower tapered guide means portion 42-A.

The upper end of body portion 36-A is provided with a male threaded portion 35 adapted for threadable engagement with the rotary drive head 20 of a conventional top head drive drilling rig. The opposing end is provided with a tapered female threaded portion 75 adapted to receive a mating male portion 77 provided on the removably mounted tapered guide means portion 42-A.

Spindle portion 32-A is also provided with a central bore or passage 37 longitudinally extending therethrough and communicating with a longitudinal passage 39 provided in the upper end of guide means portion 42-A which in turn communicates with a plurality of bores such as 41.

Therefore fluid from the rotary drive head 20 may enter passage 37 and exit through the open bores 41.

The main body portion 36-A is provided with a wrench flat 76 and a threaded area 78. Pin 38-A is removably mounted in a receiving opening provided on body 36-A. Upon removal of pin 38-A, the spindle portion may be lowered into the coupling and pipe casing upon which collar 34 is attached until the lower end of threaded area 78 engages the threads of the coupling member attached to the pipe casing.

Threaded area 78 is designed to be threadably received by the conventional pipe coupling upon rotation of the spindle 32-A.

By appropriate control of rotary drive head 20, such engagement is completed. Then the operator, via conventional controls on the drilling rig, can inject fluid, such as air or water, through the rotary drive head 20, spindle adaptor portion 32-A and into the string of pipe casing to cause circulation of the fluid in the well bore.

Such circulation of the well bore is often necessaary during the casing insertion process when the well bore becomes closed or clogged by debris from the walls of the bore. The faster an operator can begin circulating fluid into the bore to clear any such obstruction, the less likely the obstructed condition will worsen. In some instances, a blockage not treated by circulation quickly enough, can result in severe damage to the bore and require expensive procedures to clear the obstruction, or worse, cause the well bore to be abandoned.

The embodiment shown in FIGS. 5 and 6 permits very convenient and very fast adaption of spindle 36-A to permit the well to be circulated so as to avoid the most serious consequences and typically permit the insertion of the casing to continue after a very modest loss of time.

It should be pointed out that collar portion 34 could be made to include a flared skirt portion in surrounding relationship to the upper rim of body 44 to make alignment and insertion of the spindle portion more positive and require less effort for the operator.

Therefore, from the foregoing description, it should be apparent that the present invention provides a very significant improved apparatus for making up or breaking out a pipe string with relatively inexpensive capital expense, reduced labor costs, and a generally more reliable and safe operation.

What is claimed is:

1. An apparatus for stringing a plurality of threaded pipe to one another in a vertical configuration within a deep well bore comprising, in combination; a conventional well drilling apparatus including a vertically movable platform carrying a rotary drive means; a drive spindle removably mounted to said rotary drive means and including a pair of opposed lugs extending outwardly at right angles to the length of said spindle and a centering guide means at the lower end of said spindle; a friction collar means adapted for removable mounting to a conventional coupling member mounted on the end of a conventional length of pipe, said collar means including a generally cylindrical body portion having an inner diameter larger than the outer diameter of said coupling member, a plurality of adjustable gripping means disposed within said collar means and inwardly movable for frictional engagement with said coupling member, and a pair of ears fixed to the walls of said body and extending vertically beyond the upper portion of said body for cooperative engagement with said lugs on said drive spindle when said centering guide means on said drive spindle is disposed within said coupling member of a length of pipe which is positioned to be added to the pipe string to transfer rotational torque of said rotary drive means to the pipe engaged by said collar means.

2. The apparatus defined in claim 1 wherein each of said adjustable gripping means includes a threaded stem mounted in a threaded receiving member provided in the side wall of said cylindrical body portion, said stem including an inner foot portion extending radially inwardly and disposed in force-transmitting engagement with a gripping member, said gripping member provided with a recess for receiving said foot member, and stop means disposed in said recess for limiting the vertical displacement of said foot member within said recess.

3. The apparatus defined in claim 1 wherein said drive spindle is provided with a longitudinally extending passage having an inlet at the upper end and an outlet means disposed in the lower end and an outer threaded surface portion disposed intermediate the ends of said spindle adapted to be threadably received by a conventional coupling member mounted on the length of pipe being added to the pipe string, and wherein said pair of opposed lugs are removably mounted to said spindle portion between said outer threaded portion and said centering guide means.

* * * * *